US006453593B1

(12) United States Patent
Dillon

(10) Patent No.: US 6,453,593 B1
(45) Date of Patent: Sep. 24, 2002

(54) GUN BARREL WITH LONGITUDINAL SPIN PREVENTION SLOTS

(76) Inventor: Joseph C. Dillon, 10761 Jamacha Blvd. Ste. "J", Spring Valley, CA (US) 91977

( * ) Notice: Subject to any disclaimer, the term of this patent is extended or adjusted under 35 U.S.C. 154(b) by 0 days.

(21) Appl. No.: 09/785,998

(22) Filed: Feb. 16, 2001

(51) Int. Cl.[7] ..... F41A 21/00
(52) U.S. Cl. ..... 42/76.01
(58) Field of Search ..... 42/76.01, 78; 124/81, 124/83

(56) References Cited

U.S. PATENT DOCUMENTS

| | | | | | |
|---|---|---|---|---|---|
| 37,924 | A | * | 3/1863 | Steece | 42/78 |
| 587,801 | A | * | 8/1897 | Durnford | 42/78 |
| 689,502 | A | * | 12/1901 | Markham | 228/152 |
| 2,549,832 | A | | 4/1951 | Mackta | |
| 2,700,839 | A | | 2/1955 | Finlay et al. | |
| 2,849,923 | A | | 9/1958 | Cotterman | |
| 3,525,172 | A | | 8/1970 | Marshall | |
| 4,176,487 | A | | 12/1979 | Manis | |
| 4,527,348 | A | | 7/1985 | Brennan | |
| 4,546,564 | A | | 10/1985 | A'Costa | |
| 4,660,312 | A | | 4/1987 | A'Costa | |
| 4,712,465 | A | | 12/1987 | Macdonald | |
| 4,924,614 | A | | 5/1990 | Hoffmann et al. | |
| 5,086,749 | A | * | 2/1992 | Ekstrom | 124/56 |
| 5,113,842 | A | * | 5/1992 | Moormann | 124/65 |
| 5,228,427 | A | | 7/1993 | Gardner, Jr. | |
| 5,435,089 | A | * | 7/1995 | Rodney, Jr. | 42/51 |
| 5,515,838 | A | | 5/1996 | Anderson | |
| 5,565,642 | A | * | 10/1996 | Heitz | 42/17 |
| 5,630,406 | A | | 5/1997 | Dumont | |
| 5,640,945 | A | | 6/1997 | Slonaker et al. | |
| 5,669,369 | A | | 9/1997 | Scott | |
| 5,765,303 | A | | 6/1998 | Rudkin, Jr. et al. | |
| 5,782,030 | A | | 7/1998 | French | |
| 5,850,826 | A | | 12/1998 | Guthrie | |
| 5,856,631 | A | | 1/1999 | Julien | |
| 5,915,937 | A | | 6/1999 | Christiansen | |
| 6,112,447 | A | * | 9/2000 | Androsov | 42/79 |
| 6,276,354 | B1 | * | 8/2001 | Dillon | 124/31 |
| 6,295,752 | B1 | * | 10/2001 | Havlock | 124/71 |

* cited by examiner

*Primary Examiner*—Charles T. Jordan
*Assistant Examiner*—Jordan Lofdahl
(74) *Attorney, Agent, or Firm*—Donn K. Harms

(57) ABSTRACT

An improved gun barrel for use in combination with an air gun body for firing soft walled projectiles having a substantially fluid interior such as paintballs. The barrel features a plurality of longitudinal grooves operatively positioned on the interior wall of the axial chamber of the barrel to cooperatively engage portions the sidewall of the deformed soft projectile traveling therethrough. The soft projectile, such as a paint ball, is thereby prevented from rotating due to contact multiple contacts within the slots in the wall surface of the axial chamber and exits the barrel substantially void of any spin. Additional utility is provided by a scavenger located on the distal end of the barrel communicating through the barrel wall to the axial chamber to thereby vent compressed gas creating eddies behind a soft projectile during exit from the barrel.

9 Claims, 2 Drawing Sheets

GUN BARREL WITH LONGITUDINAL SPIN PREVENTION SLOTS

BACKGROUND OF INVENTION

1. Field of Invention

The present invention relates to guns which propel lightweight projectiles using compressed gas as a propellent. More particularly, it relates to an improved gun barrel for use in combination with a gas powered projectile gun firing soft or pliable ammunition such as paint balls.

2. Prior Art

Compressed air powered guns, such as paint ball guns are widely used in the forestry industry to mark trees for cutting or for saving from cutting. An even more popular use for paint ball guns is in recreation where the participants fire such firearms to propel a soft paint ball from the barrel to a target. The target may be a conventional moving or stationary paper or other target used for target practice. Or, the target of the paint ball disbursed by the gun might be another participant in a game or war game simulation wherein the participants are attempting to hit each other using paint ball guns which fire the soft paint filled projectiles.

Conventionally, paint ball guns function to fire a plastic walled, paint or gelatin filled projectile using compressed gas as the source of power, to accelerate the paint ball down an axial chamber formed in a gun barrel. The paint ball enters the barrel at the breech end from a reservoir, and accelerated by compressed gas, thereafter exits from the muzzle or distal end of the barrel, toward the intended target. Such air guns are conventionally powered by a source of compressed air or gas mixture communicated to the gun from a pressure source. Normally the communicated compressed gas supply comes from a hose connected to the gun or from a canister of highly compressed gas of the user' choosing, attached to the gun. The communicated pressurized gas, using a trigger or other activation switch operated by the user, then passes through a conduit system in the paint ball gun to power the paint ball or similar soft walled projectile down the barrel attached to the paint ball gun.

The devices disclosed herein are directed at an improved barrel configuration for use in combination with a gas-powered gun which fires paint balls or similar soft walled pliable projectiles, to greatly improve the accuracy of the projectile fired from the gun as well as the actual mechanical performance of the gun. By using the gun barrel with one, or all of the different improvements herein disclosed, a significant improvement in the accuracy of a paint ball or other soft projectile, fired from the gun used in combination herewith, is achieved.

Prior art in the area of air powered guns, and especially paint ball guns, use canisters of liquid $CO_2$ or other compressed gas communicating high pressure gas supply to regulators to provide a regulated gas supply to the gun. Gun barrels used conventionally on paint ball guns feature a smooth bore wall surface of the axil barrel chamber to protect the delicate soft wall surface of the paint ball from damage during travel down the barrel chamber.

Upon exiting the gun barrel, should the paint ball be spinning one way or the other in relation to the barrel, such a spin will affect the trajectory, and ultimately the accuracy, of the discharged projectile in hitting the intended target. Much like a golf ball, which if struck poorly, will spin and cause the ball to hook one direction or the other, a paint ball will also divert from its straight path if spin is imparted to the paint ball as it exits the barrel. Further, paint balls are deliberately formed to be soft have a liquid center covered by a thin plastic or gelatin membrane which maintains the paint ball in gum ball or globe like shape. This soft formation and thin walled construction causes frequent deformities in the shape of the paint ball making them less than perfectly round and a non perfect sphere shape. Also, a seam formed in the plastic membrane covering the liquid center of the paint ball, which is formed during manufacturer, also tends to interrupt the otherwise smooth exterior surface of the plastic membrane defining the shape of the paint ball. This seam has a natural tendency to cause spin of the paint ball when it contacts the conventionally used smooth wall bore of paint ball gun barrels.

The lack of consistency in size and shape of the paint ball ammunition can further be affected by temperature and humidity of the site where they are used. Humid weather tends to swell the paint balls larger from their original size from the water in the air softening the plastic membrane defining the dimensions of the paint ball. Hot weather increases the volume of the paint contained in the ball due to expansion thereof, and thus also At affects the overall dimensions of the paint ball during use by pressing outward on the plastic membrane cover.

Conventional smooth bore paint ball gun barrels do little to rectify the ball spin caused by the imperfect paint ball exterior surface and the variance in size caused by manufacturing or temperature and humidity at the site of use. Expanded paint balls from humidity and/or temperature spin worse on exit from the gun barrel due to increased contact with the sidewall of the axial barrel chamber. Imperfect surfaces such as the seam of the paint ball also impart spin to the exiting paint ball due to contact with the interior surface of the gun barrel. Combinations of temperature, size differential, and surface imperfections can combine to affect the trajectory of an exiting paint ball severely, and render the accuracy of the gun to a very poor state.

Finally, many conventional paint ball gun barrels include a muzzle break at the distal end of the barrel where the paint ball exits toward the target. Conventional muzzle breaks used on air guns and especially paint ball guns, are formed using drilled holes or slots in the gun barrel in a direction perpendicular to the barrel. Such conventional venting allows for some of the compressed gas to the rear of the paint ball or other projectile to vent at the distal end of the barrel thereby allowing the projectile to exit the barrel with less disturbance of the air around it. The result being a lessening of gas pressure caused disturbance at the rear of the projectile and the lessening of the accuracy of the projectile to do air disturbance around it on an exit from the barrel.

Further improvement of the accuracy provided by the barrel device herein disclosed can be achieved by placement of an improved muzzle break at the distal end of the barrel. The disclosed improved muzzle break provides increased efficiency in culling compressed gas from the projectile using elongated oval slots in the distal end of the barrel parallel to the center axis of the gun barrel, and angling the sidewalls of the slots at an angle between 30 to 50 degrees, an active parsing of the gasses, to the rear of the projectile is achieved. The use of angled sidewalls thus yields a significant improvement over conventional round perpendicular apertures that is just an exit orifice for such gasses, as in conventional muzzle brakes.

U.S. Pat. No. 5,630,406 (Dumont) teaches an improved paint ball gun with components designed to improve loading and firing mechanism of the paint ball gun. However Dumont lacks any improvements to the barrel that would decrease spin on exit of the paint ball from the barrel.

U.S. Pat. No. 5,640,945 (Slonaker) teaches an improved paint ball for use in an improved paintball gun to be used in combination therewith. However Slonaker requires special paintballs that are used in a spirally grooved barrel and would not be compatible with the majority of conventional paintballs in use world wide. Slonaker teaches a barrel that would actually impart additional spin to conventional paintballs.

U.S. Pat. 5,850,826 (Guthrie) teaches a blow gun for powering paint to the intended target but lacks any improvement on the conventional smooth bore barrel used to direct the paint ball projectile.

U.S. Pat. 5,228,427 (Gardner) features an improved barrel for use in combination with a paint ball gun and paint balls. Garder teaches the use of a plurality of apertures through the barrel wall to form a pair of helixes in the barrel. The apertures allow a venting of gas from behind the projectile however the heliacal nature of the placement imparts spin to the paint ball.

As such, there exists a need for an easily and inexpensively manufactured gun barrel for use in combination with a gun that fires soft projectiles such as paint balls. Such a device should compensate for spin of the exiting paint ball caused by the manufacturing deficiencies and deviations in dimensions of the paint ball and other soft projectile shells. Such a device should also help to stabilize the trajectory of soft projectile ammunition which suffers from dimension differences caused by heat and humidity acting on the paint ball ammunition. Such a device should further compensate for the spin or directional characteristics imparted to the paint ball by surface imperfections of the soft membrane defining the outer surface of the paint ball, as well as the fact that soft ammunition deforms during acceleration down a gun barrel causing uneven contact with the interior wall surface of the barrel. Further improvements can by achieved in paint ball ammunition accuracy by the provision of an improved muzzle break design at the distal end of the barrel, which will actively parse gasses from the barrel to reduce the drag and eddy currents on the exterior surface of the exiting paint ball.

SUMMARY OF THE INVENTION

Applicant's improved paint gun barrel device provides an easily manufactured and attached paint gun barrel for use in combination with a compressed gas operated gun firing paint balls or similar soft projectiles. It features a system of longitudinal spin prevention grooves which interrupt the smooth bore surface interior of the axial chamber of a gun barrel. The longitudinal spin prevention grooves act to contact and form to the exterior surface of the paint ball as it accelerates through the gun barrel from the breech end to discharge at the muzzle end of the barrel. In the current best mode the longitudinal grooves in the interior surface of the barrel are formed in an arch or curved shape and have rounded corners at the intersection of the arched indentation with the smooth bore surface of the barrel interior. The arched spin prevention grooves thus provide an area for the plastic membrane of the paint ball to naturally expand, while concurrently preventing tearing of the delicate membrane through the use of curved edges of the slot itself and the corners of the slot where it intersects the smooth bore surface at each end of the slot.

The arched longitudinal groves are formed in the bore of the gun barrel substantially parallel to, and equidistant from, the center axis of the axial chamber of the barrel. A plurality of the arched groves extend substantially the entire length of the interior bore of the barrel and thus contact and hold the exterior surface of the paint ball or other soft pliable projectile which expands into the groves during travel through the barrel. The result being that imperfections in size and exterior surface are compensated by the ability of the paint ball to slightly expand into the arched spin prevention groves thus preventing spin from being imparted to the paint ball. The use of rounded corners at the end of the arch forming the groove where it intersects the bore surface, and an arched shaped slot forming the spin prevention groves, prevent laceration of the delicate membrane forming the outer surface of the paint tall when it slides down the barrel.

The end result being that paint balls of differing sizes which would normally spin wildly after exiting a conventional barrel, are accommodated and allowed to expand slightly into the arched shaped spin prevention groves during their travel down the barrel, thus preventing such wild spin characteristics on exit from the barrel. Overall accuracy is improved immensely with the prevention of the spin of the paint ball at exit from the barrel.

Further improvement is achieved in the accuracy and operation of the gun by the optional muzzle break communicating with the axial cavity at the distal end, or muzzle end of the barrel. The muzzle break features a plurality of elongated slots having angled sidewalls. These elongated slots are cut into the distal end of the gun barrel and communicate therethrough parallel to the center axis of the gun barrel. As the paint ball or similar soft projectile passes though the gun barrel in the area of the elongated slots, evacuation of air pressure from the vicinity of projectile occurs through the elongated helical slots. This gas pressure evacuation is further aided by the angled sidewalls of the slots which help parse the escaping gas from the interior of the gun barrel and away from the front and rear of the accelerating projectile. The addition of the muzzle break used in conjunction with the aforementioned longitudinal spin prevention groves allows the paint ball to exit from the gun in an even straighter trajectory by eliminating air disturbance on exit from the barrel which would act on the uneven surface of the paint ball to cause spin.

An object of this invention is the provision of a gun barrel to improved accuracy for use in combination with paint ball guns and similar soft projectile guns.

Another object of this invention is to provide a gun barrel that will accommodate the variances caused in the dimensions of paint balls during manufacture and concurrently reduce or eliminate the spin imparted to paint balls in their contact with the interior of the gun barrel during use.

A further object of this invention is the provision of longitudinal spin prevention groves that are formed in the interior of a gun barrel which will accommodated expansion therein of thin walled soft projectiles and thus prevent spin, while concurrently preventing damage to the soft wall surfaces of paint balls or fluid filled soft projectiles.

A still further object of this invention is to provide an improved muzzle break for evacuation of gasses from the distal end of a gun barrel thereby increasing projectile accuracy by diminishing air turbulence reacting on the paint ball when exiting the barrel.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
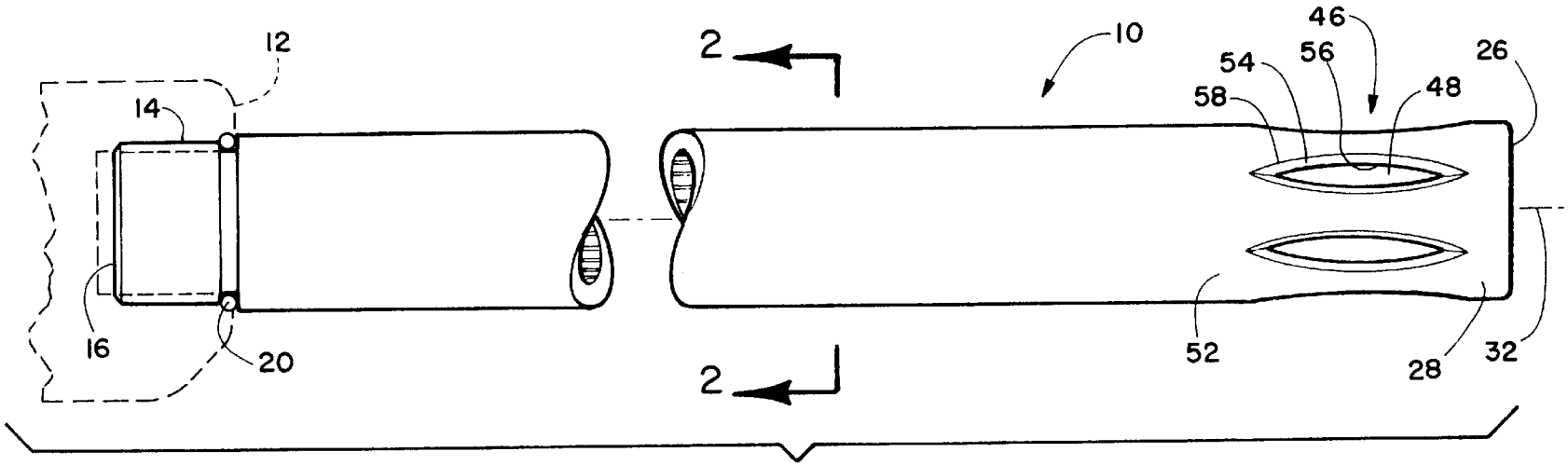
FIG. 1 is side view of the gun barrel device for use in combination with paint ball or similar soft projectile firearms.

Referring now to the drawing FIGS. 1–7 which depict the preferred embodiments of the invention disclosed herein, specifically FIG. 1 is side view of the improved gun barrel device 10 for use in combination with paint ball or similar soft projectile firearms. The barrel 10 could be sold separately for attachment to conventional existing paint ball and similar soft projectile guns, or, it could be sold already attached to a paint ball gun at the time of sale. In either case, the accuracy of the combined gun is significantly enhanced using the barrel 10 in combination therewith. The barrel 10 would cooperatively engage and attach in a sealed engagement with an operatively configured receiving cavity 17 in the body portion of a paint ball gun 12 using a means of sealed engagement to a paint ball gun 12 herein depicted in the form of threads 14 would be placed at the breech end 16 of the barrel 10 and O ring 20. The threads 14 would be configured to cooperatively engage threads in the receiving cavity 17 of body of the gun 12 in the conventional thread engagement manner and would allow the barrel 10 to reach a sealed engagement at the breech end 16 when threadably engaged with the gun body 12. The O ring 20 while not required to function, is preferred to further enhance the sealed engagement of the paint ball gun 12 where it meets the barrel 10. Of course other conventional means of sealed engagement can be used such as two cooperatively shaped bayonet style or slotted surfaces on the gun 12 and the barrel 10 and such are anticipated, but the current best mode features the aforementioned threaded engagement using threads 14 and sealing O ring 20.

In the current best mode of the barrel 10 a plurality of longitudinal grooves 22 are formed into the interior wall surface 24 of the barrel 10. The longitudinal grooves 22 communicate the entire length of the barrel 10 starting at the breech end 16 and continuing to the exit aperture 26 at the distal end 28 of the barrel 10. An axial chamber 30 having a center axis 32 is defined by the wall surface 24 inside the barrel 10. The length of the barrel 10 and the diameter 34 of the axial chamber may be varied to accommodate the appropriate sized paint ball for the desired length of travel down the axial chamber 30 when the paint ball gun 12 is fired and compressed gas from a receiving chamber in the gun having a paintball therein 42, forces the paintball 42 down the barrel 10 to an exit at the muzzle or distal end 28.

The longitudinal grooves 22 in the current best mode are defined by a single arched groove wall 36 which is machined into the interior wall surface 24 of the barrel wall 38 which forms the barrel and circular axial chamber 30. The arched groove wall 36 forming the individual longitudinal grooves 22 in the interior wall surface 24 and the barrel wall 38 feature a pair of curved corners 40 at the intersection of both ends of the arched groove wall 36 where it meets the interior wall surface 24.

The plurality of longitudinal grooves 22 about the interior wall surface 24 of the barrel 10 thus provide a means to prevent rotation of a soft walled projectile traveling through the barrel 10. The soft walled projectile such as the paint ball 42 with the aforementioned deformities normal to such projectiles would encounter the plurality of longitudinal grooves 22 when the paint ball 42 first entered the axial chamber 30 at the breech end 16 when the paint ball gun 12 is fired in the conventional manner. Compressed gas on firing, forces the paint ball down the axial chamber 30 of the barrel 10 to and out the exit aperture 26 at the distal end 28 of the barrel 10 toward the intended target. The paint ball 42 is pliable and has a soft thin sidewall 44 defining the dimension of fluid filled paintball 42. By dimensioning the diameter 34 of the axial chamber 30 substantially equal to the diameter of the paintball 42, the paintball 42 tends to expand into the longitudinal grooves 22 when fired. This is because the force of compressed gas on the rear of the accelerating paintball 42 tends to push or flattened the rear of the paintball 42 thus distorting its perimeter. Consequently, the sidewall 44 of the paintball 42 tends to extend into the longitudinal grooves 22 from the pressure of the fluid inside stretching and distorting the perimeter when the compressed gas is pushing to the rear of the pliable paint ball 42. During travel down the axial chamber 30 of the barrel toward the muzzle or distal end 28, the paint ball thus deforms about its outside perimeter to engage the longitudinal grooves. During this engagement spin is prevented because the paint ball 42 surface is constantly engaged into the longitudinal grooves 22 while traveling down the axial chamber 30 during firing.

Additional utility is provided by the barrel 10 in its ability to accommodate the many potential different spherical sizes of the paint ball 42 itself. As noted earlier, air temperature expands and contracts the size of the paint ball 42 by expanding and contracting the fluid center. Further, the flexible sidewall 44 of the paint ball 42 tends to absorb moisture in the air and thicken when the humidity is high which also can vary the dimensions of the paint ball 42. The depth of the longitudinal grooves 22 provide additional expansion area for the potential differing dimension characteristics of the paint ball 42 by allowing deformation into the grooves 42 during travel down the axial chamber 30 of the barrel. The result being that paint balls of many different dimensions due to manufacture, humidity, or ambient temperature are easily accommodated by the barrel which concurrently prevents spinning of the paintball 12 during travel and exit from the barrel 10.

An important aspect of the ability of the longitudinal grooves 22 to cooperatively engage the sidewall 44 of the paint ball 42 is the means to prevent laceration of the paintball 42 which is provided by the curved corners 40 where the two ends of the arch walled longitudinal grooves 22 communicate with the interior wall surface 24 defining the axial chamber 30 in the barrel. Since the material that makes up the sidewall 44 is made to burst on impact to release the fluid center of the paint ball 42 the sidewall 44 is conventionally quite delicate to laceration. Arching the surface to form a curved corner 40 prevents laceration of the sidewall 44 of the paint ball 42 when the paintball 42 cooperatively engages with the longitudinal grooves 22 during travel down the barrel 10. Without these curved corners 40 the sidewall 44 of the paintball 42 would be lacerated causing the paintball 42 to burst in the axial chamber 30 of the barrel.

As such, the paintball 42 when the gun is fired, may travel down the axial chamber 30 of the barrel 10 wherein it deforms into cooperative engagement with the longitudinal grooves 22 to prevent spin. The means to prevent laceration and burst of the paint ball 42 is prevented during this cooperative engagement between the thin sidewall 44 and the longitudinal grooves 22 by the curved or rounded corners 40 on each side of the grooves 22 in all configurations of the grooves 22 which serve to accommodate the thin sidewall and allow expansion into the grooves 22 while concurrently preventing sidewall laceration.

In the current best mode of the device the barrel 10 features a plurality of longitudinal grooves 22 equidistantly spaced about the surface of the axial chamber 30. The number of longitudinal grooves 22 can vary depending on the relative amount of spin prevention desired however in the current best mode from four to twenty-eight longitudinal grooves 22 may be formed into the interior wall surface 24 of the axial chamber 30 to achieve the cooperative engagement that forms the means to prevent rotation of the soft-walled liquid filled projectile traveling through the axial chamber 30. Using a currently dimensioned conventional paint ball 42, the current best mode of the device features a plurality of grooves 22 using from fourteen to twenty-four of such longitudinal grooves 22.

Figure 3:
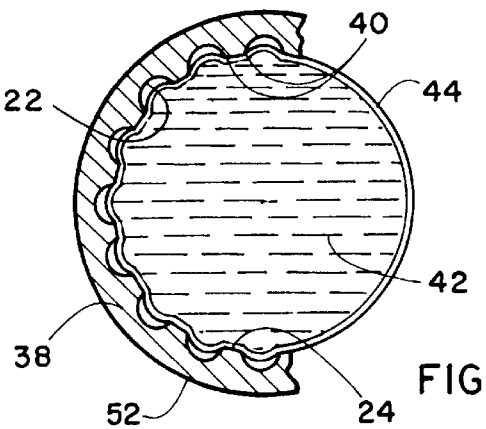
FIG. 3 is a cut away side view of the arched shaped longitudinal spin prevention groves accommodating the exterior surface of a paint ball style projectile.
Figure 2:
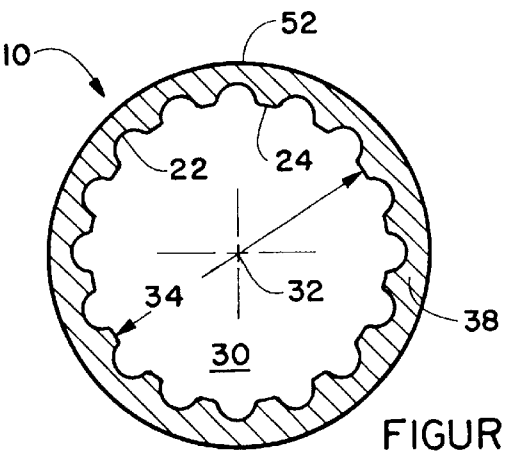
FIG. 2 is a cut away end view along line 2 of FIG. 1 depicting the arched shaped longitudinal spin prevention groves of the disclosed device.
Figure 4:
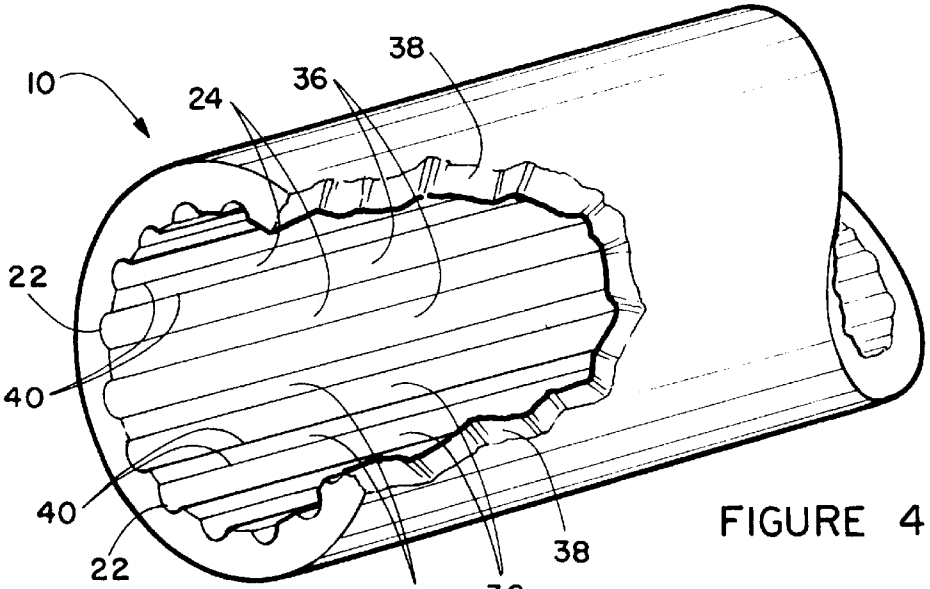
FIG. 4 is a side cut away view of the interior of the gun barrel down the center axis depicting the longitudinal spin prevention groves.
Figure 5:
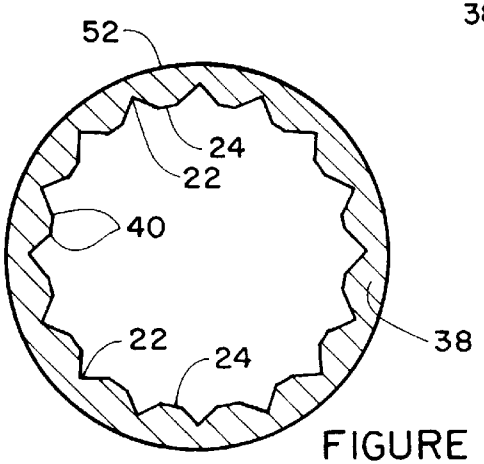
FIG. 5 is an additional end view depicting an alternative shape for the longitudinal spin prevention groves with smooth corners.
Figure 6:
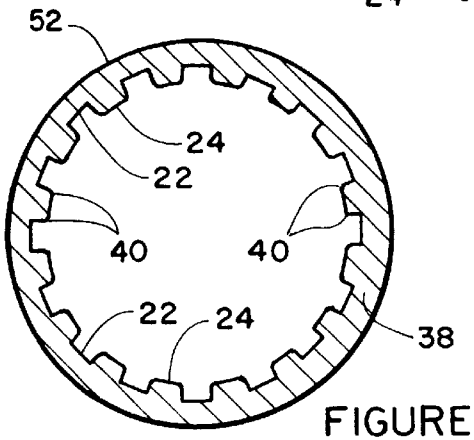
FIG. 6 depicts a triangular shape for the longitudinal spin prevention groves with smooth corner intersections with the bore of the barrel.
Figure 7:
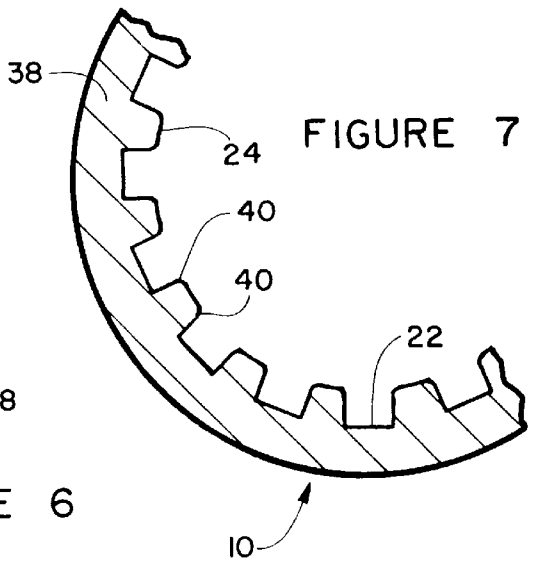
FIG. 7 depicts the rounded corner edges at the intersection of the longitudinal slot forming the spin prevention groves and the smooth bore surface of the interior of the barrel.

The longitudinal grooves 22 in the current best mode feature an arched groove wall 36 communicating at both ends with curved or rounded corners 40 as depicted in FIGS. 2, 3, and 4. However it is anticipated that other shapes for the grove wall 36 surface, and thus the dimensions of the longitudinal grooves 22 might be used because of manufacturing or other concerns such as those depicted in FIGS. 5–7 and such are anticipated. Of course the rounded or smooth corners 40 at each end of the wall defining the longitudinal groove 22 must form an intersection with the interior wall surface 24 of the axial chamber 30 that will prevent a means to prevent laceration of the paint ball 42 during travel down the barrel and its concurrent cooperative engagement with the longitudinal grooves during that travel. The rounded corners 40 provide this means to prevent laceration in the current best mode however depending on the shape of the groove 22 angled corners or padded or coated corners might be used and such are anticipated.

Additional utility may be provided by the barrel 10 device herein disclosed by the provision of an optional turbulence scavenger 46 at the muzzle or distal end 28 of the barrel 10. The turbulence scavenger 46 by itself or in combination with the longitudinal grooves 22 provides additional means to prevent spin of the paint ball 42 after exit from the axial chamber 30 when the gun is fired. This is because the compressed gas pushing the paint ball down the barrel 10 through the axial chamber 30 tends to deform the pliable paint ball 42 from pressing upon it. This pressure as noted flattens the rear of the paint ball 42 and enlarges the perimeter or hemisphere, causing the paintball to deform and the sidewalls to expand into the longitudinal grooves 22. Once the paint ball 42 has exited the barrel 10 the compressed gas to the rear of the paint ball 42 accelerates and acts as an eddy on the exterior surface of the paint ball 42 affecting its trajectory immediately after exit from the barrel 10 when the paint ball is adjacent to the distal end 28.

However, the turbulence scavenger 46, being formed by a plurality of individual longitudinal elliptical shaped slots 48 communicating through the barrel wall 38 between the axial chamber 30 and the outside atmosphere, provide an excellent means to prevent gas caused spin by scavenging compressed gas from the rear of the paint ball 42 before it exits the barrel 10. By venting the compressed gas before it can act on the exterior of the flying paint ball 42 spin or rotation from the propellent gases on exit from the barrel is prevented. Further, the disclosed turbulence scavenger 46 has performance additionally enhanced by the overall elliptical shape and the angled sidewalls 50 which serve to cut or ramp the pressurized gas rearward of the paint ball 42 from the axial chamber 30. Each longitudinal elliptical slot 48 is formed by a smaller parsing aperture 56 communicating with the interior wall surface 24 which communicates with a larger identically shaped venting aperture 58 communicating with the exterior surface 52 of the barrel 10. The passageway providing the communication between the parsing aperture 56 and the venting aperture 58 is defined by an inclining wall surface 54. The inclining wall surface 54 angling upward and away from the parsing aperture 56 to communication with the venting aperture provides an excellent ramp to parse the compressed gas from the rear of a paint ball 42 thereby increasing the efficiency of the venting.

It should be understood that while the best embodiment of the paint ball gun barrel device herein disclosed employs all of the group of individual improvements so disclosed. Greatly improved performance and utility are also achieved, using one or more of the individual improvements herein enclosed and such individual uses of the component to enhance conventional paint ball barrels is anticipated. Further, while all of the fundamental characteristics and features of the paint ball gun barrel device have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. An improved gun barrel for use in combination with a gas powered gun body for firing soft walled projectiles having a substantially liquid interior and a pliable sidewall, comprising:

a barrel having a breech end and having a muzzle end distal to said breech end;

said barrel having an axial chamber communicating therethrough between said breach end and said muzzle end, the dimensions of said axial chamber defined by a chamber wall surface;

means of sealed cooperative attachment of said breach end of said barrel to a receding aperture in said gas powered gun body;

said axial chamber dimensioned to operatively accommodate the circumference of liquid filled projectiles having a substantially soft sidewall communicated by said receding aperture to said axial passageway at said breech end, and exiting at said muzzle end, when said gas powered gun is fired;

a plurality of longitudinal grooves formed in said chamber wall surface, from said breech end to said muzzle end, each of said longitudinal grooves defined by a groove wall formed in said chamber wall surface and intersecting said chamber wall at two corners; and means to prevent rotation of said projectiles traveling through said axial passageway, said means to prevent rotation provided by said plurality of longitudinal grooves engaging portions said soft sidewall therein when said gun is fired, whereby said soft projectile is substantially prevented from rotation in any direction during travel through said axial chamber, thereby exiting said axial chamber at said muzzle end, substantially void of rotation.

2. The improved barrel as defined in claim 1 further comprising:

means to prevent laceration of said soft sidewall of said projectile when said portions are engaged in said grooves during travel through said axial chamber from said breech end to said muzzle end, thereby preventing leakage of said liquid therefrom.

3. The improved barrel as defined in claim 2 wherein said means to prevent laceration of said soft sidewall is provided by said corners of said grooves being rounded.

4. The improved barrel as defined in claim 1 wherein said means of sealed cooperative attachment of said breach end of said barrel to said gas powered gun body comprises threads about the outside circumference of said barrel cooperatively engageable with mating threads in said receiving aperture of said gun.

5. The improved barrel as defined in claim 1 further comprising a scavenging means at said muzzle end of said barrel, said scavenging means having an elliptical shaped parsing aperture formed in said chamber wall adjacent to said muzzle end;

elliptical shaped venting aperture slightly larger than said parsing aperture; and angled sidewalls communicating between said parsing aperture and said venting aperture, thereby providing a means to prevent projectile spin immediately after exit from said barrel by venting compressed gas from the rear of said projectile preventing contact of said compressed gas with the rear of said projectile.

6. The improved barrel as defined in claim 2 further comprising a scavenging means at said muzzle end of said barrel, said scavenging means having an elliptical shaped parsing aperture formed in said chamber wall adjacent to said muzzle end;

elliptical shaped venting aperture slightly larger than sand parsing aperture; and angled sidewalls communicating between said parsing aperture and said venting aperture, thereby providing a means to prevent projectile spin immediately after exit from said barrel by venting compressed gas from the rear of said projectile preventing contact of said compressed gas with the rear of said projectile.

7. The improved barrel as defined in claim 1 wherein said plurality of longitudinal grooves is a number between fourteen and twenty four.

8. The improved barrel as defined in claim 1 wherein said plurality of longitudinal grooves are placed substantially equidistant from each other.

9. The improved barrel as defined in claim 1 wherein said plurality of longitudinal grooves are arch shaped.

* * * * *